US010570667B2

(12) United States Patent
Setlur et al.

(10) Patent No.: US 10,570,667 B2
(45) Date of Patent: Feb. 25, 2020

(54) POLYCRYSTALLINE DIAMOND CUTTING ELEMENT

(71) Applicant: National Oilwell DHT, L.P., Houston, TX (US)

(72) Inventors: Deepthi Raj Setlur, Cypress, TX (US); Michael D. Hughes, Conroe, TX (US); Mark Jonathan Francis, Randwick (GB); Harold A. Sreshta, Conroe, TX (US); Guodong Zhan, Spring, TX (US); Russell C. Gilleylen, Spring, TX (US); JiinJen Albert Sue, The Woodlands, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 538 days.

(21) Appl. No.: 14/553,849

(22) Filed: Nov. 25, 2014

(65) Prior Publication Data

US 2015/0075877 A1 Mar. 19, 2015

Related U.S. Application Data

(62) Division of application No. 13/279,553, filed on Oct. 24, 2011, now Pat. No. 8,919,463.

(Continued)

(51) Int. Cl.

*E21B 10/567* (2006.01)
*B24D 18/00* (2006.01)

(Continued)

(52) U.S. Cl.

CPC ..... *E21B 10/567* (2013.01); *B22F 3/16* (2013.01); *B22F 7/02* (2013.01); *B24D 18/0009* (2013.01);

(Continued)

(58) Field of Classification Search

CPC ..... E21B 10/567; E21B 10/573; C22C 19/07; B22F 3/16; B22F 3/105

See application file for complete search history.

(56) References Cited

U.S. PATENT DOCUMENTS 2,992,900 A 7/1961 Bovenkerk
3,141,746 A 7/1964 De Lai (Continued)

FOREIGN PATENT DOCUMENTS

EP 1190791 3/2002
GB 2442135 3/2008

(Continued)

OTHER PUBLICATIONS

United Arab Emirates Patent Application No. 447/2013 First Rejection dated Jun. 6, 2016 (11 pages).

(Continued)

*Primary Examiner* — Pegah Parvini

(74) *Attorney, Agent, or Firm* — Conley Rose, P.C.

(57) ABSTRACT

A polycrystalline-diamond cutting element for a drill bit of a downhole tool. The cutting element includes a substrate and a diamond table bonded to the substrate. The diamond table includes a diamond filler with at least one leached polycrystalline diamond segment packed therein along at least one working surface thereof. The cutting element may be formed by positioning the diamond table on the substrate and bonding the diamond table onto the substrate such that the polycrystalline diamond segment is positioned along at least one working surface of the diamond table. A spark plasma sintering or double press operation may be used to bond the diamond table onto the substrate.

15 Claims, 6 Drawing Sheets

Related U.S. Application Data

(60) Provisional application No. 61/406,273, filed on Oct. 25, 2010.

(51) Int. Cl.

| | |
|---|---|
| ***E21B 10/573*** | (2006.01) |
| ***B22F 3/16*** | (2006.01) |
| ***B22F 7/02*** | (2006.01) |
| ***C22C 19/07*** | (2006.01) |
| *B22F 3/105* | (2006.01) |

(52) U.S. Cl.

CPC ..... *C22C 19/07* (2013.01); *E21B 10/573* (2013.01); *B22F 3/105* (2013.01); *Y10T 428/12174* (2015.01); *Y10T 428/12576* (2015.01)

(56) References Cited

U.S. PATENT DOCUMENTS

| | | | | |
|---|---|---|---|---|
| 3,141,885 | A | 7/1964 | Ross | |
| 3,148,161 | A | 9/1964 | Wentorf, Jr. et al. | |
| 3,574,580 | A | 4/1971 | Stromberg et al. | |
| 3,744,982 | A | 7/1973 | Bovenkerk et al. | |
| 3,831,428 | A | 8/1974 | Wentorf, Jr. et al. | |
| 3,913,280 | A | 10/1975 | Hall | |
| 4,268,276 | A | 5/1981 | Bovenkirk | |
| 4,288,248 | A | 9/1981 | Bovenkirk et al. | |
| 4,534,773 | A | 8/1985 | Phaal et al. | |
| 4,726,718 | A | 2/1988 | Meskin et al. | |
| 5,011,509 | A | 4/1991 | Frushour | |
| 5,011,514 | A | 4/1991 | Cho et al. | |
| 5,106,391 | A | 4/1992 | Lloyd | |
| 5,127,923 | A | 7/1992 | Bunting et al. | |
| 5,205,684 | A | 4/1993 | Meskin et al. | |
| 5,433,280 | A | 7/1995 | Smith | |
| 5,510,193 | A | 4/1996 | Cerutti et al. | |
| 5,544,550 | A | 8/1996 | Smith | |
| 5,645,617 | A | 7/1997 | Frushour | |
| 5,722,497 | A | 3/1998 | Gum et al. | |
| 5,776,615 | A | 7/1998 | Wong et al. | |
| 5,839,329 | A | 11/1998 | Smith et al. | |
| 5,957,006 | A | 9/1999 | Smith | |
| 5,981,057 | A | 11/1999 | Collins | |
| 6,041,875 | A | 3/2000 | Rai et al. | |
| 6,045,440 | A | 4/2000 | Johnson et al. | |
| 6,063,333 | A | 5/2000 | Dennis | |
| 6,193,001 | B1 | 2/2001 | Eyre et al. | |
| 6,200,514 | B1 | 3/2001 | Meister | |
| 6,209,420 | B1 | 4/2001 | Butcher et al. | |
| 6,353,771 | B1 | 3/2002 | Southland | |
| 6,454,030 | B1 | 9/2002 | Findley et al. | |
| 6,544,308 | B2 | 4/2003 | Griffin et al. | |
| 6,601,662 | B2 | 8/2003 | Matthias et al. | |
| 6,655,481 | B2 | 12/2003 | Findley et al. | |
| 6,852,414 | B1 | 2/2005 | Frushour | |
| 6,861,098 | B2 | 3/2005 | Griffin et al. | |
| 7,384,436 | B2 | 6/2008 | Sung | |
| 7,407,012 | B2 | 8/2008 | Keshavan et al. | |
| 7,435,478 | B2 | 10/2008 | Keshavan | |
| 7,493,973 | B2 | 2/2009 | Keshavan et al. | |
| 7,533,740 | B2 | 5/2009 | Zhang et al. | |
| 7,540,181 | B1 | 6/2009 | Memmott | |
| 7,588,108 | B2 | 9/2009 | Miyao | |
| 7,775,107 | B2 | 8/2010 | Holmquist | |
| 7,862,634 | B2 | 1/2011 | Belnap et al. | |
| 7,862,932 | B2 | 1/2011 | Eguchi et al. | |
| 7,963,348 | B2 | 6/2011 | Laird et al. | |
| 7,972,409 | B2 | 7/2011 | Fujino et al. | |
| 8,919,463 | B2 | 12/2014 | Setlur et al. | |
| 2005/0044800 | A1 | 3/2005 | Hall et al. | |
| 2005/0115744 | A1 | 6/2005 | Griffin et al. | |
| 2006/0042172 | A1* | 3/2006 | Sung | C09K 3/1409 51/309 |
| 2006/0060391 | A1 | 3/2006 | Eyre et al. | |
| 2006/0060392 | A1 | 3/2006 | Eyre | |
| 2007/0023206 | A1* | 2/2007 | Keshavan | E21B 10/16 175/374 |
| 2007/0039762 | A1 | 2/2007 | Achilles | |
| 2007/0187155 | A1 | 8/2007 | Middlemiss | |
| 2007/0277651 | A1 | 12/2007 | Calnan et al. | |
| 2008/0028891 | A1 | 2/2008 | Calnan et al. | |
| 2008/0073126 | A1 | 3/2008 | Shen et al. | |
| 2008/0142275 | A1 | 6/2008 | Griffin et al. | |
| 2009/0166094 | A1 | 7/2009 | Keshavan et al. | |
| 2010/0200305 | A1 | 8/2010 | Griffin et al. | |
| 2010/0012391 | A1 | 9/2010 | Shamburger | |
| 2010/0243336 | A1 | 9/2010 | Dourfaye et al. | |
| 2010/0282519 | A1* | 11/2010 | Zhang | B22F 7/062 175/434 |
| 2010/0288045 | A1 | 11/2010 | Holmquist | |
| 2010/0294571 | A1* | 11/2010 | Belnap | B01J 3/062 175/434 |
| 2011/0171414 | A1 | 7/2011 | Sreshta et al. | |
| 2011/0212303 | A1 | 9/2011 | Fuller et al. | |
| 2012/0097458 | A1 | 4/2012 | Voronin et al. | |
| 2013/0146369 | A1 | 6/2013 | Voronin et al. | |

FOREIGN PATENT DOCUMENTS

| | | |
|---|---|---|
| GB | 2453425 | 4/2009 |
| GB | 2455425 | 6/2009 |
| GB | 2463975 | 4/2010 |
| GB | 2463975 A | 4/2010 |
| WO | 200224601 | 3/2002 |
| WO | 200224603 | 3/2002 |

OTHER PUBLICATIONS

SPS, 'What's SPS?' [online], 8 pages, Japan, [retreived Oct. 24, 2011], Retrieved from Internet<URL: http://www.scm-sps.com/e_htm/whats_e_htm/whatsps_e.htm>.

English Translation of Chinese Third Office Action dated Aug. 21, 2015 for Chinese Application No. 201180061290.5, 14 pages.

International Preliminary Report on Patentability and Written Opinion for PCT Application No. PCT/GB2011/001531 dated May 21, 2013, 6 pages.

Examination Report for Canadian Patent Application No. 2,828,956 dated Sep. 23, 2014, 2 pages.

Examination Report for Canadian Patent Application No. 2,814,903 dated Jul. 31, 2014, 2 pages.

First Office Action and Translation for Chinese Patent Application No. 201180061290.5 dated Jul. 9, 2014, 23 pages.

International Search Report for PCT Application No. PCT/GB2011/001531 dated May 15, 2013, 4 pages.

United Arab Emirates Patent Application No. 447/2013, Second Examination Report dated May 9, 2017 (5 pages).

United Kingdom Patent Application No. GB1306962.0 Examination Report dated Jul. 31, 2017 (4 pages).

Second Chinese Office Action and Translation dated Feb. 16, 2015 for Chinese Application No. 201180061290.5, 12 pages.

* cited by examiner

POLYCRYSTALLINE DIAMOND CUTTING ELEMENT

CROSS REFERENCE TO RELATED APPLICATION

This application claims the benefit of U.S. Provisional Patent Application No. 61/406,273, filed on Oct. 25, 2010, the entire contents of which are hereby incorporated by reference herein.

BACKGROUND

1. Field

Disclosed herein are elements of superhard polycrystalline material synthesized in a high-temperature, high-pressure process and used for wear, cutting, drawing, and other applications. These elements have specifically placed superhard surfaces at locations where wear resistance may be required. In particular, disclosed herein are polycrystalline diamond and polycrystalline diamond-like (collectively called PCD) cutting elements with tailored wear and impact toughness resistance and methods of manufacturing them. One particular form of PCD cutting elements which may be used in drill bits for drilling subterranean formations are called polycrystalline diamond cutters (PDC's).

2. Description of the Related Art

U.S. Pat. No. 6,861,098 discloses methods for fabrication of PCD cutting elements, inserts, and tools. Polycrystalline diamond and polycrystalline diamond-like cutting elements are generally known, for the purposes of this specification, as PCD cutting elements. PCD cutting elements may be formed from carbon based materials with short inter-atomic distances between neighboring atoms. One type of polycrystalline diamond-like material known as carbonitride (CN) is described in U.S. Pat. No. 5,776,615. Another, form of PCD is described in more detail below. In general, PCD cutting elements are formed from a mix of materials processed under high-temperature and high-pressure (HTHP) into a polycrystalline matrix of inter-bonded superhard carbon based crystals. A trait of PCD cutting elements may be the use of catalyzing materials during their formation, the residue from which may impose a limit upon the maximum useful operating temperature of the PCD cutting element while in service.

One manufactured form of PCD cutting element is a two-layer or multi-layer PCD cutting element where a facing table of polycrystalline diamond is integrally bonded to a substrate of less hard material, such as cemented tungsten carbide. The PCD cutting element may be in the form of a circular or part-circular tablet, or may be formed into other shapes, suitable for applications such as hollow dies, heat sinks, friction bearings, valve surfaces, indenters, tool mandrels, etc. PCD cutting elements of this type may be used in applications where a hard and abrasive wear and erosion resistant material may be required. The substrate of the PCD cutting element may be brazed to a carrier, which may also be made of cemented tungsten carbide. This configuration may be used for PCD's used as cutting elements, for example, in fixed cutter or rolling cutter earth boring bits when received in a socket of the drill bit, or when fixed to a post in a machine tool for machining PCD cutting elements that are used for this purpose may be called polycrystalline diamond cutters (PDC's).

PCD cutting elements may be formed by sintering diamond powder with a suitable binder-catalyzing material with a substrate of less hard material in a high-pressure, high-temperature press. One method of forming this polycrystalline diamond is disclosed, for example, in U.S. Pat. No. 3,141,746, the entire contents of which are hereby incorporated by reference. In one process for manufacturing PCD cutting elements, diamond powder is applied to the surface of a preformed tungsten carbide substrate incorporating cobalt. The assembly may then be subjected to high temperatures and pressures in a press. During this process, cobalt migrates from the substrate into the diamond layer and acts as a binder-catalyzing material, causing the diamond particles to bond to one another with diamond-to-diamond bonding, and also causing the diamond layer to bond to the substrate.

The completed PCD cutting element may have at least one matrix of diamond crystals bonded to each other with many interstices containing a binder-catalyzing material metal as described above. The diamond crystals may form a first continuous matrix of diamond, and the interstices may form a second continuous matrix of interstices containing the binder-catalyzing material. In addition, there may be some areas where the diamond to diamond growth has encapsulated some of the binder-catalyzing material. These "islands" may not be part of the continuous interstitial matrix of binder-catalyzing material.

In one particular form, the diamond element may constitute 85% to 95% by volume of the PDC and the binder-catalyzing material the other 5% to 15%. Although cobalt may be used as the binder-catalyzing material, other group VIII elements, including cobalt, nickel, iron, and alloys thereof, may be employed.

U.S. Pat. No. 7,407,012 describes the fabrication of a highly impact resistant tool that has a sintered body of diamond or diamond-like particles in a metal matrix bonded to cemented metal carbide substrate at a non-planar interface. The catalyst for enabling diamond-to-diamond sintering may be provided by the substrate. The general manufacture of a PDC, insert, or cutting tool may use a cemented carbide substrate to provide a catalyst to aid in the sintering of the diamond particles.

Published US Patent Application US 2005/0044800, describes the use of a meltable sealant barrier to cleanse the PCD cutting element constituent assembly via vacuum thermal reduction followed by melting the sealant to provide a hermetic seal in a can used for the further high temperature, high pressure (HTHP) processing—with a temperature which may be higher than 1300C and a pressure which may be greater than 65 KBar. The sealing of the can may be required to limit contamination of the diamond particle bed during HTHP processing, and to also maintain a high vacuum in the can to limit oxidation and other contamination. The HTHP can assemblies may help to prevent contamination of the PCD cutting element table and may also be sealed by using processes, such as EB welding, used for standard production of cutters and inserts.

U.S. Pat. No. 6,045,440 describes a structured PDC that is oriented for use in earth boring where formation chips and debris are funneled away from the cutting edge via the use of raised top surfaces on the PDC. The redirection of the debris may be achieved by creation of high and low surfaces on the PDC cutting surface. A method used to form the protrusion on the PDC is not described in detail in this patent, the surface texture and geometry of this cutter surface may be limited to the ability to extrude and/or form sealing can surfaces that are a negative of the desired PDC front face extrusions, or alternatively formed by post HTHP processing, such as EDM and Laser cutting—as may be necessary to form the surfaces on the cutter face.

SUMMARY

Described herein is a process for making PCD cutting elements in a 'double pressing' operation. This process may provide PCD cutting elements with improvements in wear life over prior PCD cutting elements. Previously, high temperature, high pressure (HTHP) sintering of round discs into a PCD (polycrystalline diamond) material (or segments) manufactured in a second HTHP press cycle tended to result in cracking of the diamond material on the face of the PDC due to the stresses developed during the forming process.

The present 'double pressed' HTHP sintered PDC disclosed herein may have enhanced physical characteristics. The method for making a double pressed HTHP sintered PDC uses a previously HTHP pressed PCD material that may be leached or rendered free of all or substantially all of the metallic material is provided. This PCD material may then be crushed and sized to form a PCD grit that may be layered or dispersed with other materials and then canned & sintered into a final product PDC in a second HTHP pressing operation.

In one preferred embodiment, these canned & sintered PDC's made from previously pressed PCD cutting elements may be formed into tiles or segments (rectangular or arc shaped) and then may be leached (or substantially rendered free) of all metallic material, laid out in single or multiple layers, packed with a diamond filler (e.g., traditional diamond feedstock or diamond powder), and then HTHP sintered a second time in the normal fashion into a PDC of the present disclosure.

This method for making a double pressed HTHP sintered PDC may begin by arranging segments of previously pressed PCD segments that are leached (as described above) and laid out in a single layer or multiple layers, packed with a diamond filler (e.g., traditional diamond feedstock), and then HTHP sintered in the normal fashion into a PDC.

In another embodiment, other assorted shapes of previously pressed PCD may be selected, designed, and/or configured for advantageously arranging the stress fields within the PDC when in operation. These previously pressed PCD cutting elements may be leached or otherwise rendered free of metals and then may be combined with various combinations of diamond grit, diamond 'chunks', and/or shaped PCD segments and geometrically arranged in a pattern optimized for performance and subjected to a second HTHP cycle, cleaned up and made ready for use in earth-boring, or other related operations known in the industry.

An alternative forming process for manufacturing a PDC in accordance with the present disclosure may utilize a spark plasma sintering process (SPS) in place of the second HTHP pressing cycle. A forming process utilizing a spark plasma sintering process (SPS) may also be provided as an additional or alternative process in PDC manufacture. In this process, the powder materials may be stacked between a die and punch on a sintering stage in a chamber and held between a set of electrodes. When a pulse or a pulse stream is provided under pressure, the temperature may rapidly rise to a sintering temperature, say from about 1000 to about 2500° C. resulting in the production of a sintered PDC in only a few minutes.

DETAILED DESCRIPTION

In the following description, the sintered composite described hereafter may be formed of polycrystalline diamond (or PCD). However, this process may also be applicable to other super hard abrasive materials, including, but not limited to, synthetic or natural diamond, cubic boron nitride, and other related materials.

Polycrystalline diamond cutters (PDC's) may be used as cutting elements in drilling bits used to form boreholes into the earth, and may be used for, but not limited to, drilling tools for exploration and production of hydrocarbon minerals from the earth.

Figure 1:
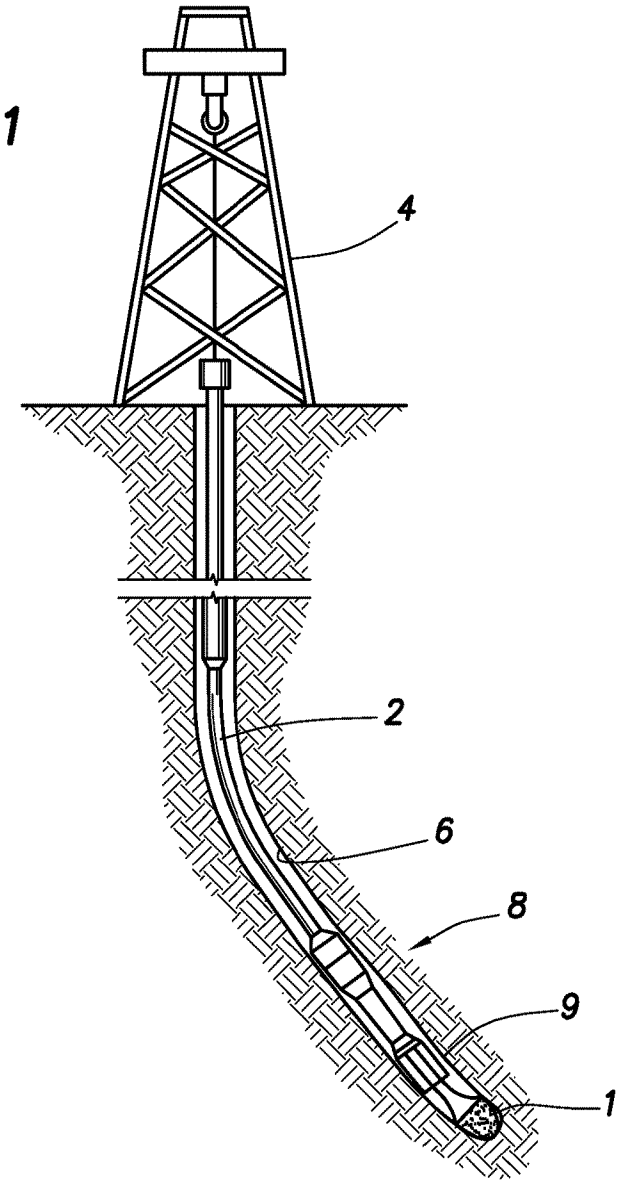
FIG. 1 is an illustrative view of a typical earth boring drill rig in operation.

For illustrative purposes only, a typical drilling operation is shown in FIG. 1. FIG. 1 shows a schematic representation of a drill string 2 suspended by a derrick 4 for drilling a borehole 6 into the earth for minerals exploration and recovery, and in particular petroleum products. A bottom-hole assembly (BHA) 8 is located at the bottom of the borehole 6. The BHA 8 may have a downhole drilling motor 9 to rotate a drill bit 1.

As the drill bit 1 is rotated from the surface and/or by the downhole motor 9, it drills into the earth allowing the drill string 2 to advance, forming the borehole 6. For the purpose of understanding how these systems may be operated for the type of drilling system illustrated in FIG. 1, the drill bit 1 may be any one of numerous types well known to those skilled in the oil and gas exploration business, such as a drill bit provided with PCD cutting elements as will be described further herein. This is just one of many types and configurations of bottom hole assemblies 8, however, and is shown only for illustration. There are numerous arrangements and equipment configurations possible for use for drilling boreholes into the earth, and the present disclosure is not limited to any one of particular configurations as illustrated and described herein.

Figure 2:
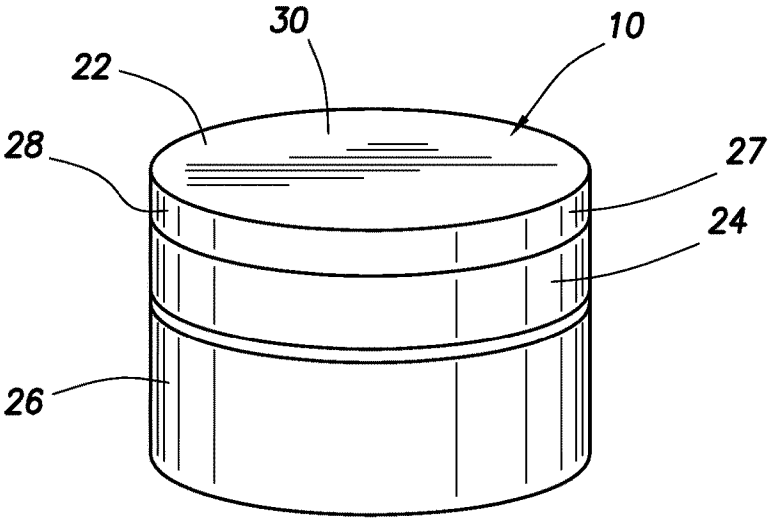
FIG. 2 is a PCD cutting element typical of those of the present disclosure.
Figure 3:
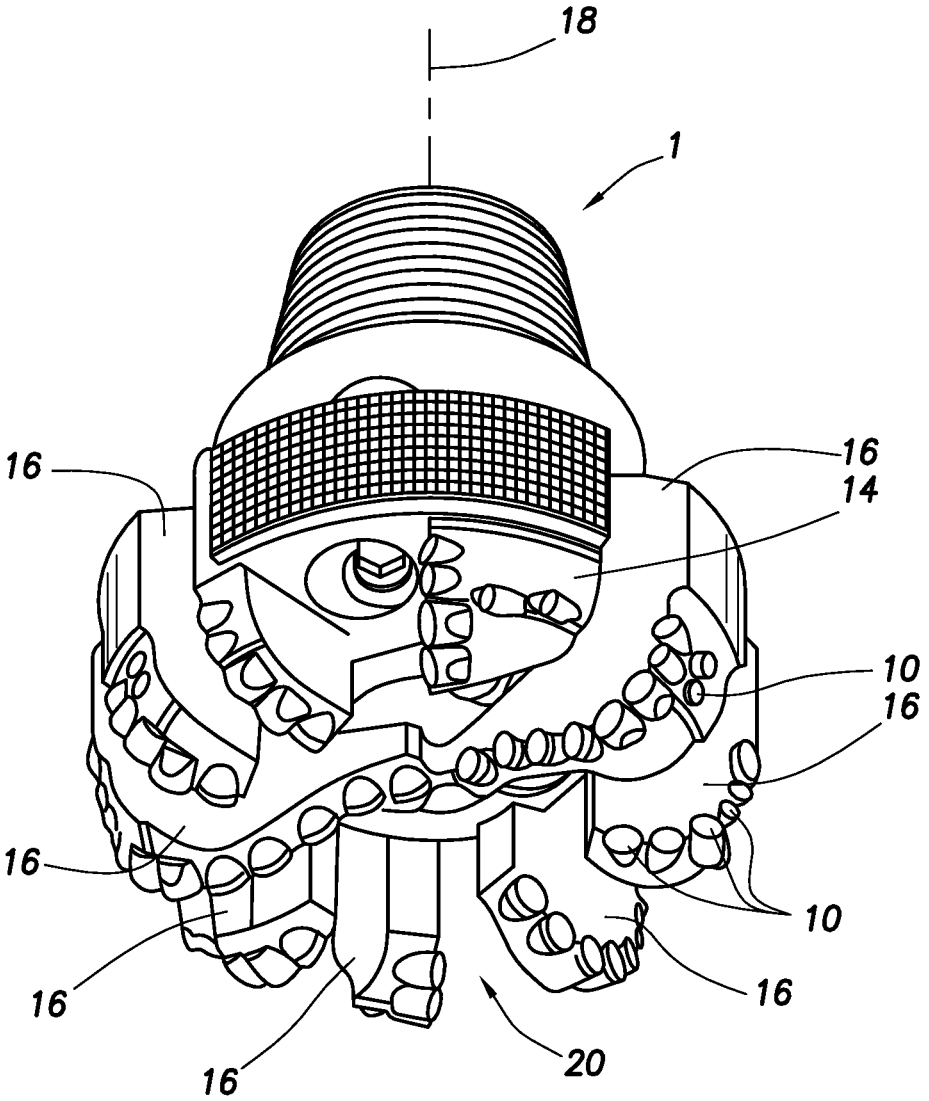
FIG. 3 is a drill bit which may utilize PCD cutting elements of the present disclosure.

A more detailed view of a PCD cutting element 10 of the present disclosure is shown in FIG. 2. Referring now to FIGS. 2 and 3, a PCD cutting element 10 of the present disclosure may be a preform cutting element 10 (as shown in FIG. 2) for the fixed cutter rotary drill bit 11 of FIG. 3. The bit body 14 of the drill bit 1 may be formed with a plurality of blades 16 extending generally outwardly away from a central longitudinal axis of rotation 18 of the drill bit 1. Spaced apart side-by-side along a leading face 20 of each blade 16 is a plurality of the PCD cutting elements 10 of the present disclosure.

The PCD cutting element 10 may have a body in the form of a circular tablet having a thin front facing, diamond table 22 of diamond bonded in a 'double press' process which may be, for example, a high-pressure high-temperature (HPHT) process. The double press process may be used to press the diamond table 22 to a substrate 24 of less hard material, such as cemented tungsten carbide or other metallic material—as will be explained in detail. The cutting element 10 may be preformed (as will also be described) and then may be bonded onto a generally cylindrical carrier 26 which may also be formed from cemented tungsten carbide, or may alternatively be attached directly to the blade 16. The cutting element 10 may also have a non-planar interface 27 between the diamond table 22 and the substrate 24. Furthermore, the PCD cutting element 10 may have a peripheral working surface 28 and an end working surface 30 which, as illustrated, may be substantially perpendicular to one another.

The cylindrical carrier 26 is received within a correspondingly shaped socket or recess in the blade 16. The carrier 26 may be brazed, shrink fit or press fit into the socket (not shown) in the drill bit 1. Where brazed, the braze joint may extend over the carrier 26 and part of the substrate 24. In operation, the fixed cutter drill bit 1 is rotated and weight is applied. This forces the cutting elements 10 into the earth being drilled, effecting a cutting and/or drilling action.

These PCD cutting elements 10 may be made in a conventional very high temperature and high pressure (HTHP) pressing (or sintering) operation (which is well known in the industry), and then finished machined into the cylindrical shapes shown. One such process for making these PCD cutting elements 10 may involve combining mixtures of various sized diamond crystals, which are mixed together, and processed into the PCD cutting elements 10 as previously described.

Forming these cutting elements 10 with more than one HTHP cycle may be called 'double pressing'. 'Double pressing' of cutters has been attempted in the past and may provide some improvement in wear life results of the products, but the process for manufacture may entail difficulties and internal defects. These defects may involve limited wear life of the resulting product. In particular, HTHP sintering of round discs into a PDC in a second press cycle may lead to cracking of the diamond layer due to stresses developed during the process.

An alternate process for double pressing PCD cutting elements as described herein involves double pressing an HTHP sintered PDC. Previously pressed PCD material may have all metallic materials removed from its crystalline structure by, for example, acid leaching. The PCD material may then be crushed and sized to form a fine PCD grit. This PCD grit may be layered (or otherwise dispersed) in a normally canned and sintered PCD cutting element. Optionally, the grit may be mixed with 'virgin' diamond crystals of selected shapes and sizes before being canned and sintered. The previously pressed PCD material may be leached before and/or after it is crushed and/or formed.

In another embodiment, previously pressed PDC segments (or tiles) of various shapes, including but not limited to triangular, rectangular, circular, oval and arc shaped, are first rendered substantially free of all catalyzing and other metallic material, typically in a leaching process, and laid out in a mold with a single or multiple layer configuration. The spaces between these tiles may then be packed with diamond filler (e.g., traditional diamond feedstock) of one or more selected sizes and shapes, and HTHP sintered a second time to form the new PDC of the present disclosure.

In one particular example, a number of 'pie' shaped previously pressed PDC segments were fully leached of catalyzing material and then laid out in a single (or alternately multiple) layer(s) in a mold, and the intervening spaces were then packed with fine grained, traditional diamond feedstock. The resulting product was then HTHP sintered a second time in the normal fashion into a PDC.

Additionally, 'stress engineered' shapes (e.g., geometries of PCD cutting elements that make advantageous use of the operating behavior of the PCD cutting element) of previously pressed PCD may also be utilized. These 'recycled' PCD cutting elements may be leached of substantially all of the metallic and/or catalyzing material they may have remaining These 'recycled' PCD cutting elements may then be combined with, or selectively used in, various combinations of crushed diamond grits and/or solid shapes to form a PDC. In this manner, the PDC may then be patterned for optimized performance.

As shown in FIGS. 4 through 8, and will be explained in more detail later, the PCD material in the form of pie shaped pieces, tiled layers, tiny blocks and/or other segments may be assembled and combined with a finer PCD grit (either new or left over from earlier process of filling separate cans) along with standard available diamond feedstock to form a PDC. These PDC were then HTHP pressed in a normal cycle imparting a second press to the previously pressed & leached parts.

In another example, the manufacturing process may begin with a fine (~5 micron distribution) HTHP diamond feedstock made into a large diameter circular PDC blank, as may be used with cutting tools. This large PDC blank may then be cut into a number of smaller pieces (or segments) that may be, but not limited to, pie-shaped tiles, cylinders, blocks, or one of many other geometric shapes. The diagonal dimension of these pieces may be, but is not limited to, sizes smaller than about 1.0 mm. These pieces may then be leached to remove all or substantially all of the metallic materials that may be present, such as tungsten carbide (WC) substrate, cobalt (Co), and any other metallic materials which may be present. These pressed and leached pieces (or segments) of PCD may then be combined with fine powdered diamond feedstock as described above and pressed a second time in the HTHP process as previously described, resulting in a preformed PCD cutting element of the present disclosure.

This preformed PCD cutting element was comparison tested to the 'standard product' known prior art PCD cutting element in a two part internal standard wear test procedure known as a G-ratio test.

Based on historical data, an unleached 'standard product' PCD cutting element may have a G-ratio (which is a number indicative of the wear resistance of the PCD material) of about $20\times10^5$ (volume of diamond removed/volume of granite removed). If the cutting surface of this 'standard product' PCD cutting element is leached substantially free of catalyzing material, the typical G-ratio may increase to about $80\times10^5$. This increased G-ratio may be a number typical for conventional leached prior art cutting elements. By way of comparison, a 5 micron 'double pressed' cutting tool made in accordance with the present disclosure using a 5 micron average particle size diamond feedstock and tested in a similar fashion as described above may have a G-ratio of $50\times10^5$ before leaching and a G-ratio of $150\times10^5$ upon leaching—nearly a 100% improvement over the 'standard product' PDC cutting element. During the second pressing operation, some of the pore spaces of the previously pressed & leached portion of the diamond table may be re-filled with the binder/catalyzing material (e.g., cobalt) to drop the G-ratio.

In another example, before leaching, abrasion testing of the double pressed PDC cutting element may yield a G-ratio of about $100\times10^5$. Upon leaching, the G-ratio of this previously pressed, leached, double pressed & re-leached PDC cutting element may increase to about $1000\times10^5$, yielding over a tenfold increase in wear resistance over the 'standard product' leached PDC. It should be noted that laboratory tests may not account for all the variability's of PDC cutting elements as they are run in the field. Therefore, although laboratory test results may be helpful for selecting which of the cutting elements may be better, field testing may be performed for confirmation.

The new PDC may provide improved abrasion resistance over existing PDC cutting elements. In addition, the loose diamond feedstock packing within the PCD material pieces may provide a form of stress relief in the final product. In addition, tiling the diamond layer may result in a relatively stress free, yet very thick PCD layer. In addition, the fine feedstock of the previously pressed PCD cutting element may provide an additional incremental increase to the abrasion resistance of the resulting PDC without using a significantly higher pressure during processing.

The PCD grit may be varied in grit size, quantity, and layer thickness to vary the physical properties of the final product, as may be required. The comparable wear patterns of the various PCD grit options may reveal differential wear rates between the previously pressed, leached, double pressed, and re-leached product and the loose feedstock packed around that grit, HTHP sintered and leached for the first time. These differential wear rates may allow the PDC cutting edge to become 'self-sharpening' for a more efficient cutting action at the rock.

The various grit options may also be useful in cases where an edge of the PDC were to chip during operation. The differential wear rate of the PDC may favor smaller pieces being dislodged rather than creating larger chunks. This may be characteristic of a more homogenous, traditionally produced diamond table. In addition, the 'double pressed' product may provide a way to reuse the 'used' PDC material recovered from 'dull', previously used cutters. The initial pressed feedstock for double HTHP pressing may be made into pie, tiled or block shapes. Alternatively, the PDC's may be free standing—thereby potentially reducing the need for finishing & cutting.

In the manufacturing process for the PCD 50, it may be desirable to control the feedstock of the double pressed PDC, the grit size of the previously pressed PCD grit, the mix ratio of the PCD grit with loose diamond feedstock, the particle size of the loose feedstock, the layer thickness, and (where present), and the geometrical arrangement of the PCD segments or tiles. This may be used to minimize the residual stress for providing a stress free product, controlled layer thickness of the PCD grit mix, leaching process, and leach depth.

In performing the present applications, it may be necessary to control a number of process parameters. These may include, for example, origin of feedstock of the double pressed PDC, the previously pressed grit size, the mix of the PCD grit with loose diamond feedstock, and the size of the loose feedstock. Other process parameters to control may involve controlling the layer thickness, and designing the geometrical arrangement of the segments or tiles for a stress free product. In addition, the layer thickness of the PCD grit mix, the leaching process, and the leach depth may require close control.

In some circumstances, it may also be desirable to treat the PCD produced in a further leaching process to remove all of, or selected portion(s) of, any catalyst infiltrant that may have re-infiltrated the PCD layer.

Figure 5:
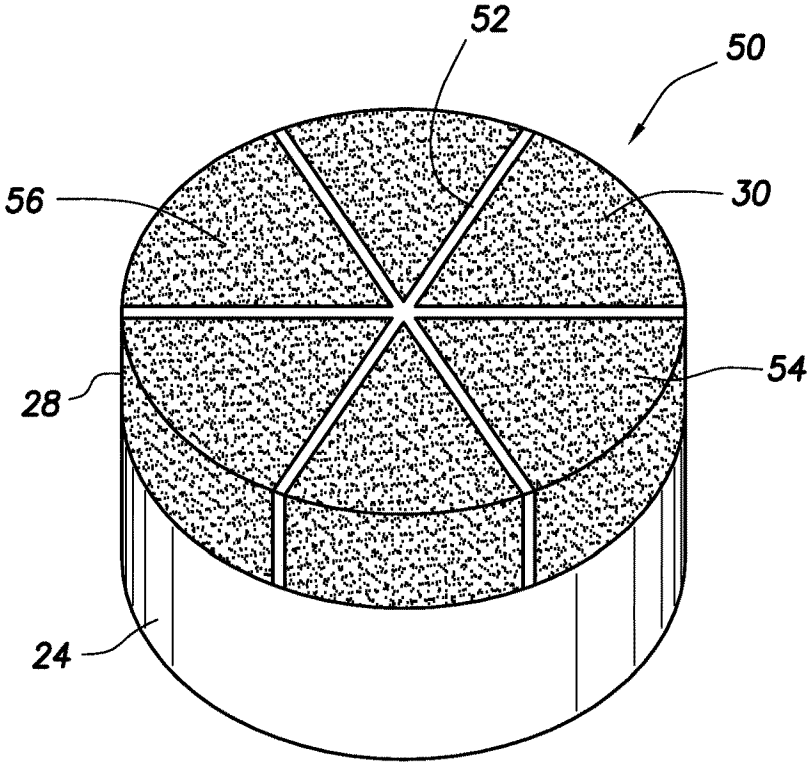
FIGS. 4 and 5 are perspective views of one embodiment of the present disclosure using segmented pieces of leached PCD material.
Figure 4:
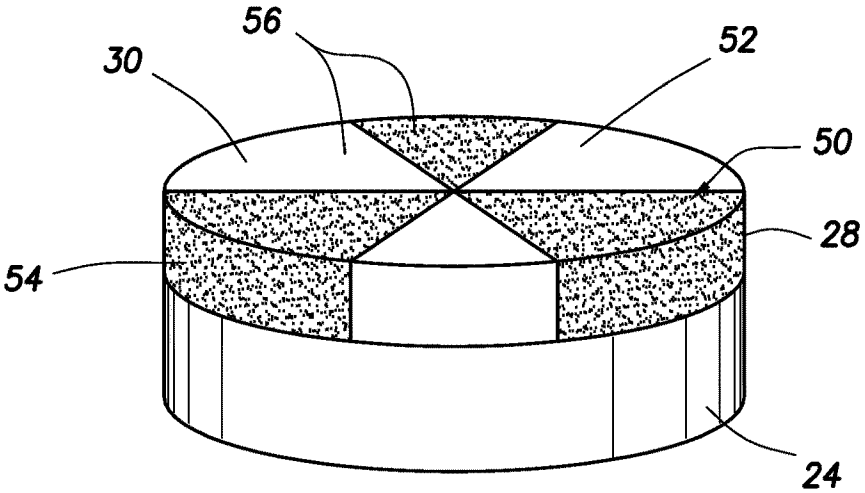

In addition to being useful for PCD cutting elements 10 with an integral face (or working surface 30) as shown in FIG. 2, these components may also be used as PCD 50 with segmented faces 56 as shown in FIGS. 4 and 5.

As shown in FIG. 4, the segmented faces 56 may have alternating segments 52, 54 comprising leached PCD segments 54 substantially free of catalyzing materials, alternating with non-leached PCD segments 52 containing catalyzing material.

In an alternate embodiment, as shown, in FIG. 5, the PCD cutting element 50 may have separate segmented leached PCD segments 54 which are all PCD material, leached to be substantially free of all catalyzing material or any metallic materials which may be present. Although 'wedge' shaped PCD 50 have been illustrated herein, it is contemplated that many different shapes of PCD components, including round, oval, rectangular, arc-shaped, triangular, star, etc., may be used as PCD 50 without departing from the scope of the present disclosure.

For instance, the above described PCD cutting element 50 may have non-leached PCD segments 52 between leached PCD segments 54 and may be used as PCD cutting elements in much the same manner as the PCD cutting element 10 with integrally formed faces.

Figure 7:
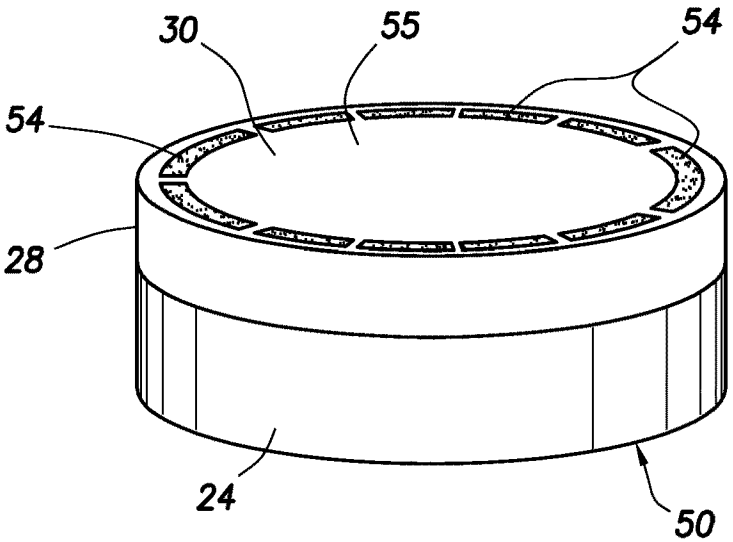
FIGS. 6 and 7 are perspectives views of individual blocks of leached PCD material arranged in another embodiment of a PCD cutting element of the present disclosure.
Figure 6:
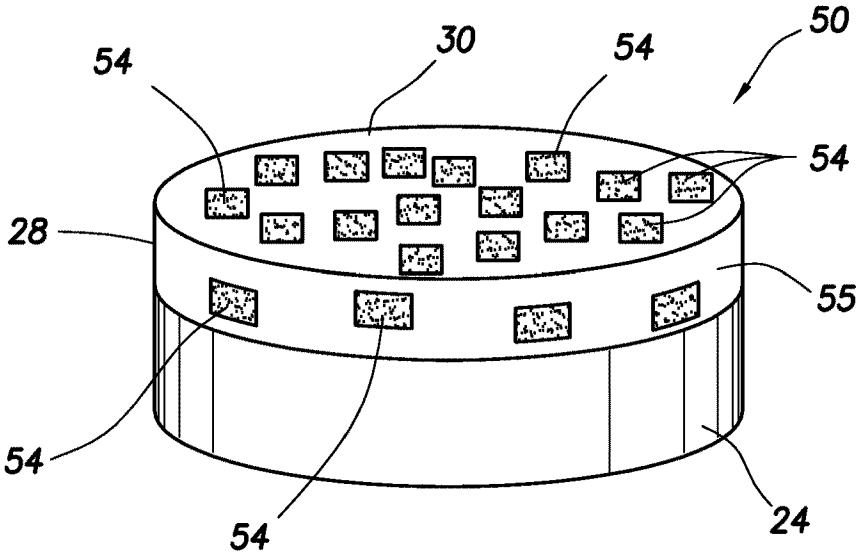
Figure 8:
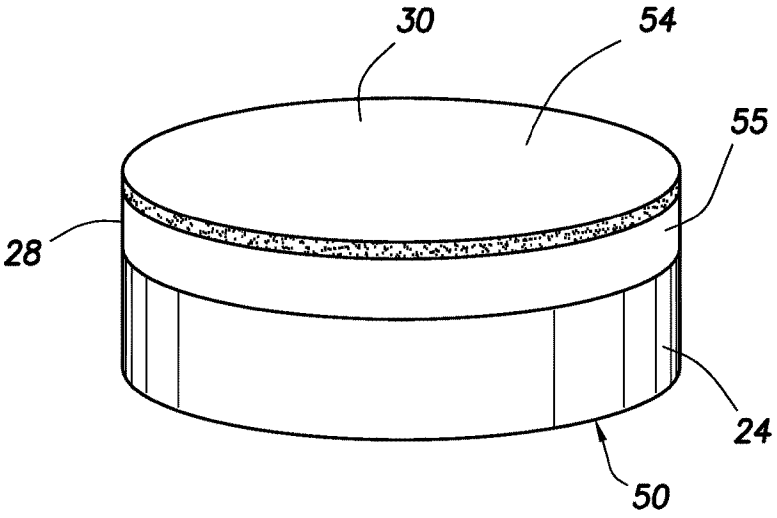
FIG. 8 is a perspectives view full disc of leached PCD material in still another embodiment of a PCD cutting element of the present disclosure.

In still other embodiments, the pre-leached PCD material 54 may have selected shapes and sizes for the PCD 50, for example as shown in FIGS. 6, 7, and 8. In FIGS. 6 and 7, individual blocks of leached PCD material 54 that are substantially free of catalyzing materials are placed with the diamond powder in production cans along with diamond filler (e.g., standard available diamond feedstock) 55, such that after the second HTHP press cycle the leached PCD material 54 is integrally formed with the PCD cutting element 50. In FIG. 6, the individual blocks of leached PCD material 54 are placed in a mosaic pattern on the face, effectively covering the entire face (or end working surface 30) of the PCD 50 in leached PCD material 54.

Alternately, the individual blocks of leached PCD material 54 may be shaped and laid in an arc around the periphery (or peripheral working surface 28) of the PCD cutting element 50 as shown in FIG. 7. Again, after the second HTHP press cycle, the pre-leached PCD material 54 becomes integrally formed with the PCD cutting element 50. This arrangement may optimize the amount of pre-leached PCD material 54 needed for each PCD cutting element and also may help in controlling the process of the second press cycle.

Finally, in another embodiment as shown in FIG. 8, it may be desirable to form the entire working surface (or facing table) with a single disc of leached PCD material 54. The PCD material is positioned on the feedstock 55.

In each of these embodiments, as described herein, the entirety of the working surfaces 28, 30 (or portions thereof) of the PDC 50 may be leached a second time in a leaching process, and then assembled into a drill bit 1, or other wear component.

Figure 9:
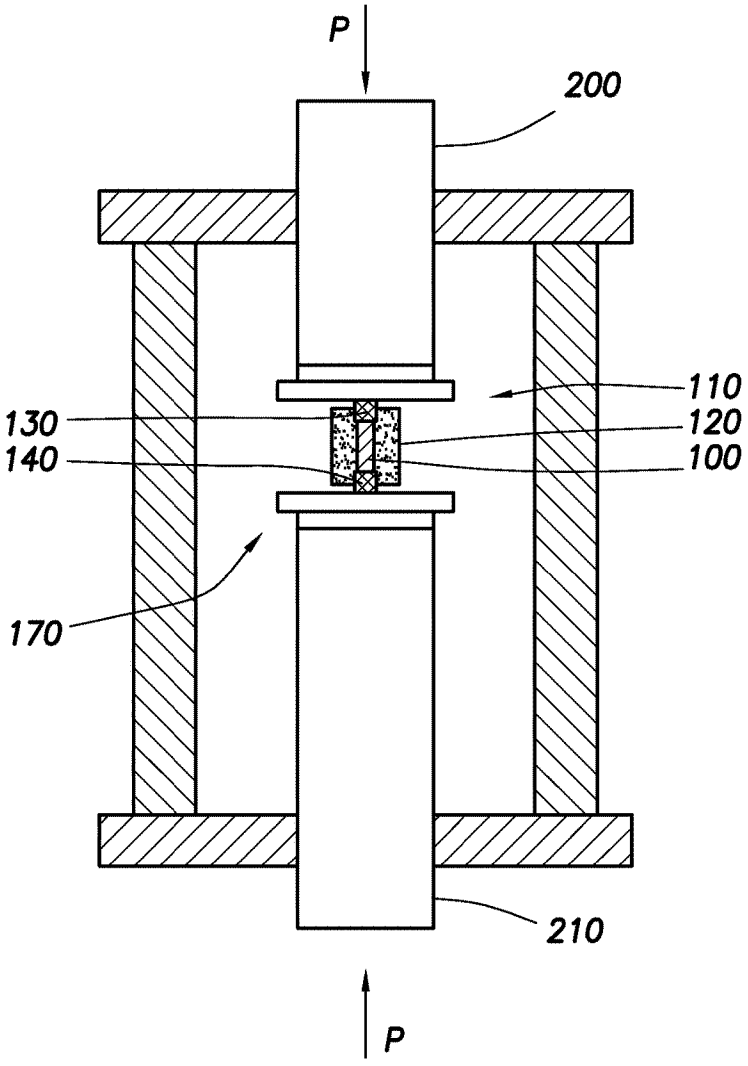
FIG. 9 illustrates a spark sintering process which is an alternate process for forming the PCD cutting element of the present disclosure.

In addition, an alternative forming process for manufacturing a PCD cutting element 50 may utilize a spark plasma sintering process (SPS) as illustrated in FIG. 9. In this process, pre-sintered discs (or stack) 100 of previously pressed diamond powder materials may be stacked within in a cylindrical vacuum chamber 110 mounted within a sintering die 120 arranged between an upper punch 130 and a lower punch 140. A sintering die 120 located between upper punch 130 and a lower punch 140 on a sintering stage 170 and is held between a set of 'spark' electrodes 200, 210. The resulting 'stack' 100 has sufficiently high electrical resistivity to allow a high voltage differential applied to the 'stack' 100 to cause sparking between and among the diamond powder materials.

When moderate mechanical pressure is applied to the 'stack' 100, as shown by the letter 'P', and the voltage is maintained across the stack through upper electrode 200 and lower electrode 210, the combination of the pressure P, and sparking allows the 'stack' 100 to form diamond-to-diamond bonds of PCD, similar to those formed in the traditional HTHP process commonly used for diamond synthesis. Since the electric pulse (or pulses) is (are) provided to the discs 100 under moderate compressive pressure P, the temperature within the discs 100 may rapidly rise to sintering temperature, for example, at about 1000° C. to about 2500° C., resulting in the production of a near finished sintered PCD cutting element 50 in only a few minutes. The PCD cutting element 50 may be finished (e.g., trimmed) following various stages of the manufacture, such as after a first pressing, after a second pressing and/or after SPS.

This SPS process or other microwave process may be used to bond or attach a diamond layer, such as a partially (or fully) leached diamond wafer, to a carbide substrate. These processes may be used with low temperature, low pressure bonding or attaching methods. The bonding may be performed using an alloy or compound, such as a nano-alloy compound (e.g., Ni-nano-WC, or a Ni-nano diamond alloy). For example, Ni-nano-WC (Nickel-nano-tungsten carbide) may be used to join 20 μm diamond powders with a WC—Co substrate. In another example, SPS is used to bond a partially (or fully) leached flat diamond wafer to a carbide substrate with nano-WC 65%+NiCrFeBSi.

Figure 10:
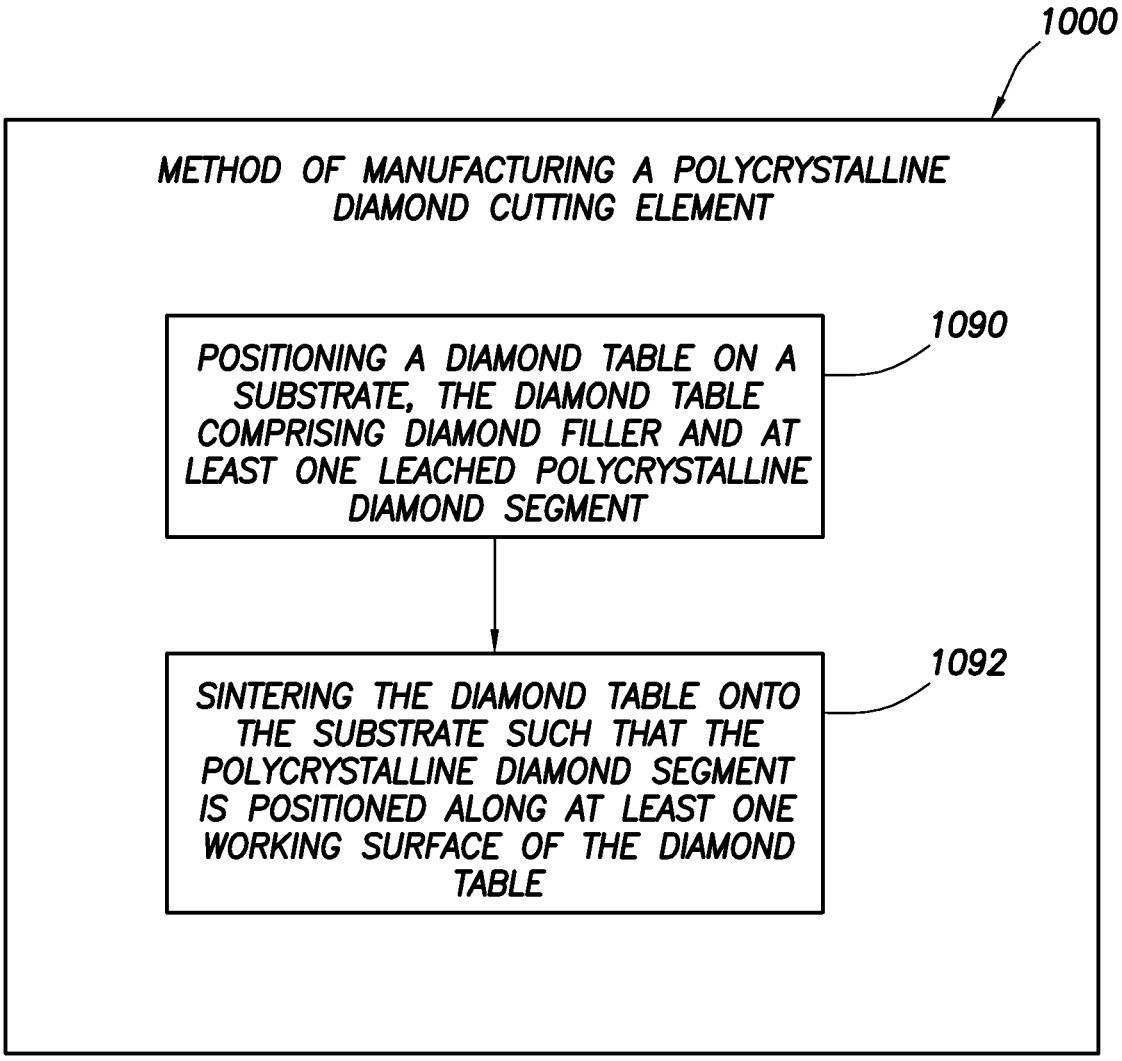
FIG. 10 depicts a flowchart describing a method of making a PCD cutting element of the present disclosure.

FIG. 10 shows a method 1000 for manufacturing a PCD cutting element. The method involves positioning 1090 a diamond table on a substrate (the diamond table has diamond filler and at least one leached polycrystalline diamond segment), and sintering 1092 the diamond table onto the substrate such that the polycrystalline diamond segment is positioned along at least one working surface of the diamond table. The steps may be performed in any order and repeated as desired. The sintering may be an SPS sintering or a double press operation as described herein.

Whereas the present invention has been described in particular relation to the drawings attached hereto, it should be understood that other and further modifications apart from those shown or suggested herein, may be made within the scope and spirit of the present disclosure.

What is claimed is:

1. A method for manufacturing a polycrystalline diamond cutting element for a drill bit of a downhole tool, comprising:

creating small polycrystalline diamond particles by sintering a first polycrystalline diamond material in a first high temperature-high pressure pressing operation having a temperature higher than 1300° C. and a pressure greater than 65 KBar and forming the sintered polycrystalline diamond material into small particles of about 0.5 micron in size by crushing the sintered polycrystalline diamond material;

removing substantially all catalyzing and other metallic materials from the sintered polycrystalline diamond material;

intermixing the polycrystalline diamond particles with another diamond material to form a diamond table;

positioning the diamond table on a substrate;

bonding the diamond table onto the substrate by a second high temperature-high pressure pressing operation having a temperature higher than 1300° C. and a pressure greater than 65 KBar such that the at least a portion of the polycrystalline diamond particles are positioned along at least one working surface of the diamond table.

2. The method of claim 1, wherein the removing comprises leaching the sintered polycrystalline diamond material.

3. The method of claim 1, wherein the intermixing comprises intermixing at least some of the polycrystalline diamond particles with the another diamond material to form the diamond table, wherein the at least some of the polycrystalline diamond particles are selected for intermixing based upon at least one of a size or a shape of the polycrystalline diamond particle.

4. The method of claim 1, further comprising positioning the plurality of small polycrystalline diamond particles along one or more of a top and peripheral working surface of the polycrystalline diamond cutting element.

5. The method of claim 1, wherein the removing is performed either before or after the small, polycrystalline diamond particles are formed.

6. The method of claim 1, wherein the polycrystalline diamond cutting element has a higher wear resistance than a polycrystalline diamond cutting element comprising a diamond table comprising no material that has been sintered prior to formation of the diamond table.

7. The method of claim 1 further comprising forming the small, polycrystalline diamond particles into a grit, and varying the size, quantity, and layer thickness of the grit to provide a polycrystalline diamond cutting element that is self-sharpening.

8. The method of claim 1, wherein the another diamond material comprises diamond feedstock, diamond powder and combinations thereof.

9. The method of claim 1, wherein the another diamond material comprises a second polycrystalline diamond material.

10. The method of claim 1, wherein the polycrystalline diamond particles are positioned along at least one of a top and peripheral working surface of the polycrystalline diamond cutting element.

11. A method for manufacturing a polycrystalline diamond cutting element for a drill bit of a downhole tool, comprising:

leaching a plurality of stress engineered polycrystalline diamond shapes;

sintering a first polycrystalline diamond material in a first high temperature-high pressure pressing operation having a temperature higher than 1300° C. and a pressure greater than 65 KBar to form a first sintered polycrystalline diamond material and forming the first sintered polycrystalline diamond material into a plurality of particles with an average diameter of 0.5 microns;

removing substantially all catalyzing and other metallic materials from the first sintered polycrystalline diamond material;

subsequent to the leaching of the plurality of stress engineered shapes, intermixing the sintered first polycrystalline diamond material with the plurality of stress engineered shapes to form a diamond table;

positioning the diamond table on a substrate;

bonding the diamond table onto the substrate by a second high-temperature-high pressure pressing operation having a temperature higher than 1300° C. and a pressure greater than 65 KBar such that the at least a portion of the leached polycrystalline diamond particles are positioned along at least one working surface of the diamond table; and subsequent the bonding, treating all or a portion of the at least one working surface in a leaching process to remove all or select portions of any catalyst that may have infiltrated during the bonding of the diamond table onto the substrate.

12. The method of claim 11, further comprising removing a plurality of metallic material from the plurality of stress engineered shapes by leaching.

13. The method of claim 11, further comprising removing a plurality of catalytic material from the plurality of stress engineered shapes by leaching.

14. The method of claim 11, wherein each stress engineered shape of the plurality of stress engineered shapes was part of a previously fabricated and previously used PCD cutting element.

15. The method of claim 11, further comprising selecting at least some stress engineered shapes of the plurality of stress engineered shapes prior to leaching based on at least one of a size or a geometry of the at least some stress engineered shapes.

* * * * *